United States Patent [19]

Althoff

[11] 4,108,433

[45] Aug. 22, 1978

[54] TENNIS RACKET WITH WARM-UP WEIGHT

[76] Inventor: Bruce B. Althoff, 2602 Windwood Ct., Atlanta, Ga. 30360

[21] Appl. No.: 768,419

[22] Filed: Feb. 14, 1977

[51] Int. Cl.[2] ..... A63B 69/38

[52] U.S. Cl. ..... 273/29 A

[58] Field of Search ..... 273/29 A, 73 R, 73 H, 273/73 D, 73 J, 73 C, 73 E, 74, 171, 165, 193 R, 194 R

[56] References Cited

U.S. PATENT DOCUMENTS 1,203,786 11/1916 Ricords ..... 273/74

FOREIGN PATENT DOCUMENTS 1,050,631 12/1966 United Kingdom ..... 273/74

*Primary Examiner*—Richard C. Pinkham
*Assistant Examiner*—T. Brown
*Attorney, Agent, or Firm*—Robert B. Kennedy

[57] ABSTRACT

A warm-up weight device for a racket having an oval head merging at a racket throat with a racket handle and comprising a flexible member of oval shape having an elongated slot extending substantially between two mutually spaced ends thereof, and a flexible connector flexibly connecting the two tube ends together.

7 Claims, 8 Drawing Figures

TENNIS RACKET WITH WARM-UP WEIGHT

BACKGROUND OF THE INVENTION

This invention relates generally to rackets used in playing sports such as Tennis, Racket Ball, and the like, particularly to devices adapted to be attached to such rackets for added weight during warm-up exercises.

Heretofore, various items of sports equipment have been provided with weights for use during pre-game exercise periods. For example, in U.S. Pat. No. 3,414,260 an adjustable weight exerciser is provided for use with tennis rackets, golf clubs or baseball bats. With tennis rackets the weight is mounted in the center of the racket head in lieu of racket strings. In U.S. Pat. No. 3,913,911 a pair of weights are rigidly secured to either side of the racket head adjacent the racket throat. In U.S. Pat. No. 3,801,099 supplementary dead weights are secured along the sides of a tennis racket head frame while in U.S. Pat. No. 3,907,292 a set of weights is movably positioned inside a racket head frame. Some of these devices have been designed to be used exclusively during warm-up periods in advance of actual play, while with others improved racket performance during play has been sought.

The just described tennis racket attachments and modifications of a permanent nature have obviously not been intended to constitute warm-up devices as such inasmuch as the racket weight remains the same both during warm-up periods as well as during play. Conversely, those devices by which weights are secured to a racket head frame in lieu of racket strings have been intended to provide rackets for use exclusively during warm-up and without convertibility therafter to a playing racket of ordinary play weight. Thus it is often desirable to use a warm-up device for a tennis racket or the like which may be detachably mounted to a conventional racket during warm-up period and then removed for regular play.

Heretofore, as exemplified by U.K. Pat. No. 3,126, a locking device consisting of concentric rings or discs has been provided for attachment to the strings of the tennis racket to render it unfit for use until the device is unlocked and removed from the racket head. Such a device inherently does add weight to the racket head thereby rendering it suitable in retrospect as a warm-up device. However, since the locking device is secured to the playing surface of the racket head it is not feasible to actually stroke balls with the racket during the warm-up exercise. Furthermore, such a device may damage the strings if the racket is used with it attached. In French Pat. No. 1,376,724 a removable plug is provided adapted to be detachably mounted to a tennis racket throat in altering the weight of the racket head. Inherently, such a device could also serve as a warm-up attachment. However, this device is attached through the use of a threaded screw assembly necessitating the use of an ancillary tool. Furthermore, the detachable weight is added at the approximate position of the center of gravity of the entire racket which tends substantially to lessen its effectiveness.

Accordingly, it is a general object of the present invention to provide an improved warm-up device for a tennis racket or the like.

More specifically, it is the object of the invention to provide a warm-up device for a racket which may be detachably secured to the racket head.

Another object of the invention is to provide a warm-up device for a racket of the type described which, when attached, does not interfere with the playing surface of the racket head.

Another object of the invention is to provide a warm-up device for a racket which may be attached and detached with ease.

Another object of the invention is to provide a warm-up device for a racket which, when attached to a racket head, is held snuggly and securely in place.

Yet another object of the invention is to provide a warm-up device for a racket of relatively simple and economic construction and which does not appreciably detract from the aesthetic appearance of the racket when attached thereto.

SUMMARY OF THE INVENTION

In one form of the invention a warm-up device is provided for a racket having an oval head merging at a racket throat with a racket handle. The device comprises a flexible tube of generally open-ended oval shape having an elongated slot extending substantially between two mutually spaced tube ends. A flexible connector flexibly connects the two tube ends together. So constructed, the tube may be detachably fitted snuggly about substantially the entire periphery of an oval racket head and held in place by the connector overlaying the racket throat thereby providing added weight to the racket head during warm-up exercises.

In another form of the invention a racket is provided having a warm-up device detachably mounted thereto. The racket comprises a racket head having a general oval shaped periphery, a racket handle mounted to the racket head at a racket throat, and a flexible, slotted tube mounted flush about the oval periphery of the racket head with two tube ends positioned closely adjacent one another straddling the racket throat. A flexible connector is mounted about the racket throat secured to the two tube ends thereby holding the tube ends snuggly to opposite sides of the racket throat.

DESCRIPTION OF THE PREFERRED EMBODIMENTS

Figure 1:
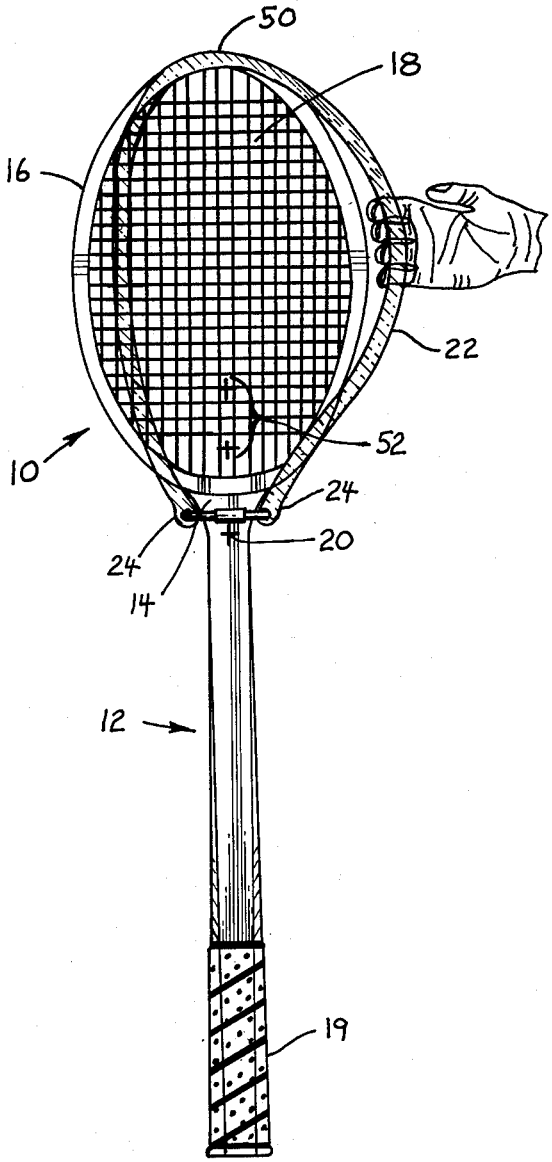
FIG. 1 is a front elevational view of a conventional racket showing a warm-up device embodying principles of the present invention being manually attached thereto.

Referring now in more detail to the drawing, there is shown in FIG. 1 a tennis racket having a head 10 unitarily mounted to a handle 12 at a throat 14. The racket head comprises an oval shaped head frame 16 to which a set of strings 18 are tautly mounted. A grip 19 is provided on the end of the racket handle distal the racket head. So constructed, the racket is of conventional, modern-day construction with its center of gravity located at point 20.

Figure 2:
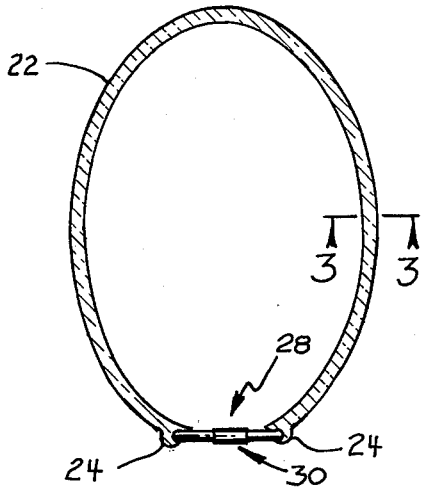
FIG. 2 is a front elevational view of the warm-up device of FIG. 1 shown in a manually unstretched, relaxed position.
Figure 3:
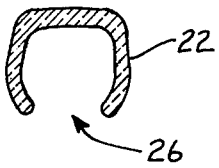
FIG. 3 is a cross-sectional view of the warm-up device shown in Figure taken along Plane 3—3.

With continued reference to the drawings, and particularly to FIGS. 1-3, the warm-up device is seen to comprise a flexible tube 22 having two tube ends 24 between which extends an elongated slot 26. Preferably, the tube is molded with vinyl wall of ⅛ inch thickness. In this embodiment the vinyl is of clear composition although it may be opaque or coated with paint for color coordination with the racket.

As seen in FIG. 2 the tube is molded into a shape approximating that of the racket head frame. More specifically, the tube is molded into a generally oval shape having an open end 28 located between the two tube ends 24. A flexible connector 30 is secured to the two tube ends passing through an apperture 32 formed in each tube end. The connector is of closed loop configuration sized to receive a racket handle loosely therethrough and a racket throat snuggly therethrough.

Figure 5:
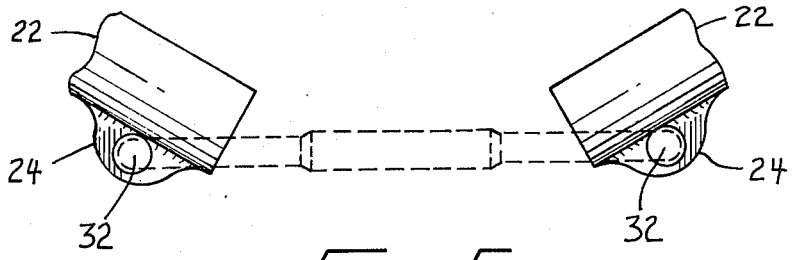
FIG. 5 is an enlarged view of end portions of the tubular component of the warm-up device shown in FIG. 1 ready to receive connector portion as shown in broken lines during device assembly.
Figure 6:
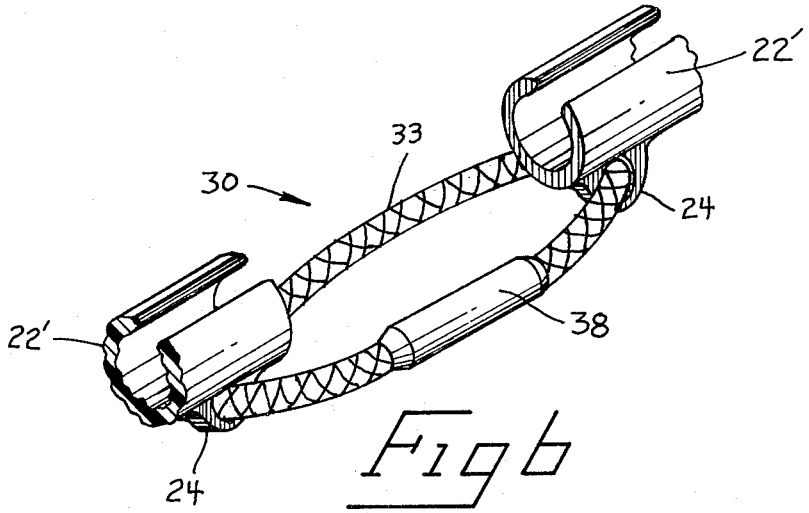
FIG. 6 is a perspective view of the end portions of the tubular component of the warm-up device shown in FIG. 1 with the connector component shown assembled thereto.
Figure 7:
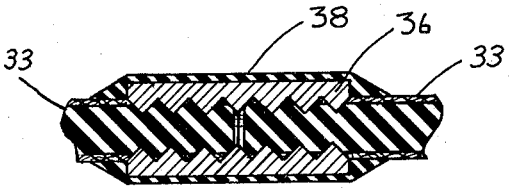
FIG. 7 is a cross-sectional view of that portion of the connector shown in FIG. 6 where two connector ends are joined together following assembly of the connector to the two tube ends.
Figure 8:
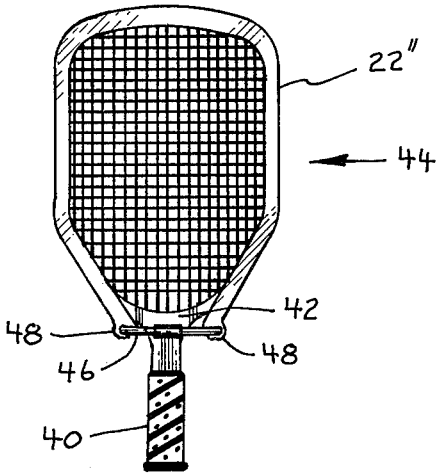
FIG. 8 is a front elevational view of a racket paddle having a warm-up device embodying principles of the present invention detachably secured thereto.

With reference to FIGS. 5-7, the connector is seen to be preferably formed of a flexible shock cord 33 of cylindrical cross-section configuration. During manufacture the two tube ends are positioned as shown in FIG. 5 and then the cord is passed through the two openings in the tube ends 24, and the connector ends placed in abutment as shown in FIG. 7. A metal clamp 36 is then squeezed about the confronting end portions of the end connector thereby permanently gripping them together. A split tube of rubber 38 is then placed about the clamp and its seam vulcanized whereupon the flexible connector permanently secures the two ends of the flexible tube together. In FIG. 6 the tube 22′ is alternatively seen to be of a split, cylindrical construction instead of the U-sahpe configuration shown in FIG. 3. Furthermore, as shown in FIG. 8 the tube 22″ can be performed into an overall shape of rackets other than used for tennis play. Specifically, in this Figure the tube 22″ is formed into the shape of the periphery of a conventional racket paddle having a handle 40, throat 42 and head 44. Again, a flexible connector 46 secures the two tube ends 48 together encircling the racket throat.

The warm-up device may be readily attached to the head of a racket by first passing the racket handle through connector 30 and then placing that portion 50 of tube 22 distal the racket throat onto the head frame. This may be easily accomplished since the tube is flexible and already formed in a shape and size approximating that of the peripheral exterior of the racket head frame. As shown by the illustrated human hand in FIG. 1, the side portions of the tube extending from point 50 are then pulled onto the sides of the racket head. In actuality, this process is found to be swift and easy to accomplish. Once completely placed snuggly about the periphery of the racket head the connector serves to hold the device firmly in place during use with resulting center of gravity of the racket being shifted to a point between those areas noted by reference 52 along the racket axis.

Figure 4:
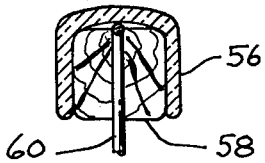
FIG. 4 is another cross-sectional view of the warm-up device illustrated in FIG. 2 shown mounted snuggly to the head frame of a wooden tennis racket.

As shown in FIG. 4, a flexible tube 56 can equally well be adapted to be placed about a racket head frame 58 of wooden construction which strings 60 are conventionally strung. When warm-up exercises have been completed a side of the tube may be readily urged away from the racket head and then point 50 slipped off whereupon the entire tube becomes loose thereby enabling the user to slide the device off the racket by passing handle 12 throught the connector.

It should be understood that the just described embodiments merely illustrate principles of the invention in a selected form. Many modifications additions and deletions may, of course, be made thereto without departure from the spirit and scope of the invention as set forth in the following claims.

I claim:

1. A warm-up device for a racket having an oval head merging at a throat with a handle and with said device comprising, in combination an elongated, one-piece, flexible member of generally u-shaped cross-section and being of open-ended oval shape, each end of said member being provided with a traverse aperture and a flexible connector extending through each of said apertures and flexibly connecting said ends together, whereby said flexible member may be detachably fitted snuggly about substantially the entire periphery of an oval racket head and held in place between the legs of said u-shaped and by said connector overlaying the racket throat in providing added weight to the racket head during warm-up exercises.

2. A warm-up device in accordance with claim 1 wherein said flexible connector is of closed loop configuration.

3. A warm-up device for a racket having an oval head merging at a throat with a handle and with said device comprising, a combination an elongated, one-piece flexible member of generally u-shaped cross-section and being of open-ended oval shape, and a flexible connector of closed loop configuration sized to receive the racket throat therethrough flexibly connecting the ends of said member together, whereby said member may be detachably fitted snuggly about substantially the entire periphery of an oval racket head and held in place by the legs of said u-shaped and said connector overlaying the racket throat in providing added weight to the racket head during warm-up excerises.

4. A warm-up device in accordance with claim 3 wherein said flexible connector comprises a cord having two cord ends held loosely together in an end to end relationship by a metallic clamp encapsulated within a resilient protective cover.

5. A racket having a warm-up device detachably mounted thereto and comprising a racket head having a generally oval shaped periphery, a racket handle mounted to said racket head at a racket throat, a one-piece, elongated, u-shaped, flexible member mounted flush about said oval periphery of said racket head with its ends positioned closely adjacent one another straddling said racket throat, and a flexible connector mounted around said racket throat and secured to said member ends thereby holding said ends snuggly to opposite sides of said racket throat and holding said oval shaped priphery between the legs of said u-shaped cross-section.

6. A racket in accordance with claim 5 wherein said racket head, racket handle and racket throat form a tennis racket.

7. A racket in accordance with claim 5 wherein said racket head, racket handle and racket throat form a racket paddle.

* * * * *